US005507142A

United States Patent [19]

Wintonyk

[11] Patent Number: 5,507,142

[45] Date of Patent: Apr. 16, 1996

[54] HYBRID STEAM ENGINE

[76] Inventor: James D. Wintonyk, Box 90 The Wilderness, Kerrville, Tex. 78028

[21] Appl. No.: 409,694

[22] Filed: Mar. 24, 1995

[51] Int. Cl.[6] ..... F02G 3/02

[52] U.S. Cl. ..... 60/39.63

[58] Field of Search ..... 60/39.6, 39.62, 60/39.63; 123/197.1

[56] References Cited

U.S. PATENT DOCUMENTS

| | | | |
|---|---|---|---|
| 581,385 | 4/1897 | Woillard | 60/39.6 |
| 972,504 | 10/1910 | Brown | 60/39.63 |
| 1,065,604 | 6/1913 | Gray | 123/197.1 |
| 1,510,688 | 10/1924 | La Fon | 60/39.63 |
| 4,079,586 | 3/1978 | Kincaid | 60/39.63 |
| 4,696,158 | 9/1987 | DeFrancisco | 60/39.62 |

*Primary Examiner*—Michael Koczo
*Attorney, Agent, or Firm*—Gunn, Lee & Miller

[57] ABSTRACT

A hybrid steam engine device which has a rotor fixed between two end plates with rotor shaft bearings which allow the rotor to move freely about its axis. A pair of guide bars rigidly connect one end plate to the other. A fixed piston pairs are rigidly attached to each end plate. A multiplicity of hollow cylinders are mounted to allow simultaneous closure of each cylinder end by one pair of pistons, with a septum plate mounted approximately half-way along the interior of each cylinder providing compression for one piston at the same time that expansion is provided for the opposing piston. A compressor piston has two valves. An intake check valve provides fresh air into the compressor side of the cylinder during expansion and the compressor check valve provides entry of compressed air to a retort, where combustion and conversion to steam occurs. The power piston also has two valves. A power check valve provides for the entry of gases produced by combustion and steam. The exhaust check valve provides for the exit of these gases and steam into a condenser, which recovers water for reintroduction into the boiler.

20 Claims, 3 Drawing Sheets

HYBRID STEAM ENGINE

BACKGROUND OF THE INVENTION

1. Field of the Invention

Applicant's invention relates generally to steam engines modified to increase operational efficiency. More specifically, the invention pertains to a new and improved steam engine with an internally fired generator that makes use of exhaust condensate as the primary source of steam, this steam in turn being used to reduce emissions and supplement the power produced by combustion.

2. Background Information

The low operational efficiency of conventional internal combustion engines derives from exhaustion of waste heat to the atmosphere along with heat lost through the cooling system. Steam engines lose most of their operational efficiency through the energy consumed by converting water to steam.

U.S. Pat. No. 1,424,798 discloses an explosive engine wherein steam is produced by mixing preheated water directly with a portion of the combustion gases that have been diverted from the power stroke of the piston. This steam is later readmitted to the same cylinder after the combustion gas has been completely exhausted and is allowed to expand to produce a steam driven power stroke. U.S. Pat. No. 1,424,798 describes a two-cycle engine modified to operate in a four cycle manner. The modification involves complex and costly construction and retains the limitations and disadvantages of conventional two-cycle engines. Moreover, operational efficiency is reduced significantly due to power lost by diverting combustion gases from the power stroke to produce steam.

U.S. Pat. No. 4,783,963 attempts to improve efficiency of the internal combustion engine by grouping cylinders into pairs, each pair containing a combustion driven piston and a steam driven piston. Combustion is initiated in the first cylinder, wherein the burning gases are forced through a common transfer valve (during the exhaust cycle) into the second cylinder, where hot water is injected to produce steam and power the second cylinder through an exhaust cycle. The system of U.S. Pat. No. 4,783,963 has the disadvantage of friction/power losses associated with the extra piston for steam driven power.

In an attempt to combine both steam and combustion power for the operation of a single piston, U.S. Pat. No. 4,433,548 utilizes a complicated system of valves and pumps to condense water from exhaust gases and reintroduce the condensate for a conversion to steam. Separate power and steam strokes drive a single piston in the same direction. Such a system provides the advantages of both steam and combustion engines on alternating strokes, but also provides widey varying torque between each stroke at low speeds.

An invention which provides steam during the power stroke of the engine is disclosed by U.S. Pat. No. 4,122,803. However, the device is directed toward the installation of a boiler ring around the periphery of each cylinder head in a modified conventional internal combustion engine.

Another method of combining internal combustion and steam power is described in U.S. Pat. No. 4,706,462. In this invention, the piston is either driven purely by internal combustion or steam. A water jacket surrounds the cylinder head and when enough heat is gathered to produce steam, the ignition mechanism for the piston is deactivated and a steam valve is opened to power the piston using the newly generated steam. When there is no longer sufficient heat for steam generation, the ignition system for the piston is reactivated to power the piston by combustion and create more heat for additional steam generation. The system of U.S. Pat. No. 4,706,462 may also result in widely varying torque availability, as the piston is alternately powered by combustion and steam.

U.S. Pat. No. 4,976,226 contemplates inserting an additional two cycles of steam power within the traditional two or four cycle operational sequence of the internal combustion engine. Instead of the usual exhaust cycle, the exhaust valve is held closed while water is injected into the cylinder near the end of the power stroke so that a new compression stroke is added in place of what would have been the exhaust stroke. As a result, heat accumulated in the walls of the cylinder during the course of the preceding power stroke is transmitted to the cooled and compressed combustion products and the injected water mist so that the resulting steam produces an additional power stroke. The exhaust valve is then opened during the sixth stroke so that the newly expanded gases may be forced out of the cylinder. This system has the efficiency disadvantage of using a power stroke to generate steam.

U.S. Pat. Nos. 5,125,366 and 5,261,238 are both concerned with the timing of water injection for combustion engines. U.S. Pat. No. 5,125,366 discloses a water injection system that is computer controlled. Injection in this system is responsive to a multiplicity of sensors which monitor conditions at various points of a conventional internal combustion engine. U.S. Pat. No. 5,261,238 injects water only after combustion has been initiated within a cylinder and uses the heat produced to convert injected water into steam so as to increase the force produced by the power stroke. The invention of U.S. Pat. No. 5,125,366 also discloses the use of additional compound cylinders which are powered by the expanding exhaust gases and steam generated within the power cylinders. Neither of these inventions makes use of carefully controlled combustion outside the cylinder to produce steam for injection into the cylinder, as does the instant invention.

U.S. Pat. No. 5,191,766 makes use of heated exhaust gas to produce steam, which is then used to operate a power takeoff mechanism, such as a turbine. This power take-off mechanism is used to augment the power supplied by internal combustion. The invention does not make use of the steam to power the engine directly.

U.S. Pat. No. 4,023,367 discloses a steam engine which is made more efficient by using waste heat to preheat air entering the steam generation mechanism. However, this invention separates the steam generation and combustion processes so that no additional power is derived from the combustion process itself.

The present invention overcomes the problems presented by the above-mentioned references. In addition, the instant invention provides the benefits of high torque at low speeds, running more quietly than conventional internal combustion engines, since all combustion occurs outside the cylinder in a carefully controlled, non-explosive fashion.

SUMMARY OF THE INVENTION

It is an object of the present invention to provide a hybrid steam engine which overcomes the problems inherent in the prior art.

It is also an object of the present invention to provide a hybrid steam engine which is more efficient to operate than conventional steam engines that produce steam by the indirect application of heat to water.

It is a further object of the present invention to provide a hybrid steam engine which is more efficient than conventional internal combustion engines that waste heat through direct exhaust of combustion gases.

It is yet another object of the present invention to provide a hybrid steam engine which does not emit more pollution at higher speeds as a result of incomplete combustion.

A still further object of the present invention is to provide a hybrid steam engine which produces steam by combining heat from combustion directly with water.

It is also an object of the present invention to provide a hybrid steam engine which requires relatively few parts and is therefore more reliable, and less expensive to manufacture, than conventional internal combustion engines.

It is a further object of the present invention to provide a hybrid steam engine which is operable with a plurality of cylinders.

It is also an object of the present invention to provide a hybrid steam engine which provides power utilizing a double-ended reciprocating piston that operates between two fixed cylinders, or alternatively, utilizing two stationary pistons that operate within the confines of each reciprocating cylinder.

It is yet another object of the present invention to provide a hybrid steam engine which can be manufactured using conventional components.

A still further object of the present invention is to provide a hybrid steam engine which uses exhaust condensate to provide substantially all of the water required for steam generation, such that very little water must be added from an external source to sustain operation.

It is also an object of the present invention to provide a hybrid steam engine which provides high torque at low speeds.

It is a further object of the present invention to provide a hybrid steam engine which can operate at relatively low temperatures and pressures, as compared to conventional internal combustion engines.

It is yet another object of the present invention to provide a hybrid steam engine which reduces the release of oxygen nitrides to the atmosphere as compared with conventional internal combustion engines.

It is also an object of the present invention to provide a hybrid steam engine which may use liquids other than water, or mixed with water, to produce steam when heated by the combustion process.

It is a further object of the present invention to provide a hybrid steam engine which is constructed of materials, or coated with materials, such that conventional lubrication of cylinders, pistons, and valves is unnecessary.

It is yet another object of the present invention to provide a hybrid steam engine which has lean burn capability.

A still further object of the present invention is to provide a hybrid steam engine which provides safety valves to control excess pressure and one-way intake/exhaust valves to prevent deleterious blowback of gases.

In accordance with the present invention, a hybrid steam engine is disclosed comprising a rotor which is mounted between two end plates. Rotor shaft bearings are affixed to each end plate so as to allow the rotor to move freely about its axis. Attached to the end plates are a pair of guide bars, which rigidly connect one end plate to the other, and several pairs of fixed pistons, each piston rigidly attached to its respective end plate. Hollow cylinders are mounted so as to cover each pair of pistons, and a septum plate is mounted half way along the interior of each cylinder so as to isolate each pair of fixed pistons, providing compression for one piston at the same time that expansion is provided for the opposing piston.

One piston of each pair, called the compressor piston, has two valves. The intake check valve provides fresh air into the compressor side of the cylinder during expansion and the compressor check valve provides for expulsion of the compressed air to a retort, where combustion and steam production occurs. The opposing piston of each pair, called the power piston, also has two valves. The power check valve provides for the entry of steam and gases produced by combustion within the boiler. The exhaust check valve provides for the exit of these gases and steam into a condenser, which recovers water for reintroduction into the boiler. A retort within the boiler is fitted with a source of ignition and fuel injection to provide combustion. The output of the boiler is provided with a throttle to regulate the amount of gas and steam introduced to the cylinder at the power piston. Both the boiler and the condenser are fitted with safety valves to vent excess pressure to the atmosphere.

The reciprocating motion of each cylinder is converted to rotary motion of the shaft by a rotor cam follower pin which fits into a rotor cam groove encircling the rotor shaft. This cam groove is cut at some angle between parallel to, and perpendicular with, the rotor shaft axis of rotation. Attached to one end of the rotor shaft is a valve cam plate which serves to actuate the power and exhaust valves for each power cylinder. Also attached to one end of the rotor shaft is a starter gear used for initial operation of the hybrid steam engine.

Since the hybrid steam engine requires relatively few parts, it is inherently more reliable, and less expensive to manufacture, than conventional internal combustion engines. Additional manufacturing economy is realized through the use of commonly known components. The hybrid steam engine is expected to operate efficiently, since combustion and steam production both occur outside of the cylinder. In contrast with conventional internal combustion engines, the hybrid steam engine is not expected to emit more pollution at higher speeds as a result of incomplete combustion, but should be able to provide high torque at low speeds and the ability to operate at relatively low temperatures and pressures. The production of oxygen nitrides should be reduced by the selective addition of water to the combustion process. Additional efficiency is provided by the recirculation of heated water from the exhaust to the retort for steam production. The present hybrid steam engine concept is preferably operated as a four or six cylinder power plant, but may be expanded to any number of cylinders. High temperature, low friction materials may be used to obviate the need for a conventional lubrication system and further simplify the construction of the hybrid steam engine.

To operate the hybrid steam engine, the starter gear is turned by any conventional means so as to spin the rotor shaft, causing each cylinder to move in a reciprocating fashion. This is by virtue of the rotor cam follower pin attached to the center of the cylinder. Compressor piston valves operate so that fresh air is introduced into that side of the cylinder and compressed. This compressed air is then introduced to the retort inside the boiler. Fuel is injected to the retort at this time. When the proper stoichiometric ratio of air and fuel exists, the ignition source is energized so as to provide combustion within the retort. Water is added to the boiler by the condenser and when enough steam pressure has been built up, the throttle is opened, allowing steam and gases resulting from combustion to enter the power side of the cylinders. When sufficient power exists to support compression, the starter gear may be disengaged from the starting mechanism. Exhaust gas from the power side of the cylinders is then forced into the condenser, where water is recovered for reintroduction into the boiler and excess gas pressure is vented to the atmosphere.

It should also be noted that the hybrid steam engine may be constructed with fixed cylinders that are rigidly attached to their respective end plates. Double-ended pistons would then be connected to the rotor shaft (using rotor cam follower pins) so as to move in a reciprocating fashion within each cylinder pair. All other operations of the hybrid steam engine remain the same.

DETAILED DESCRIPTION OF THE PREFERRED EMBODIMENT

Figure 1:
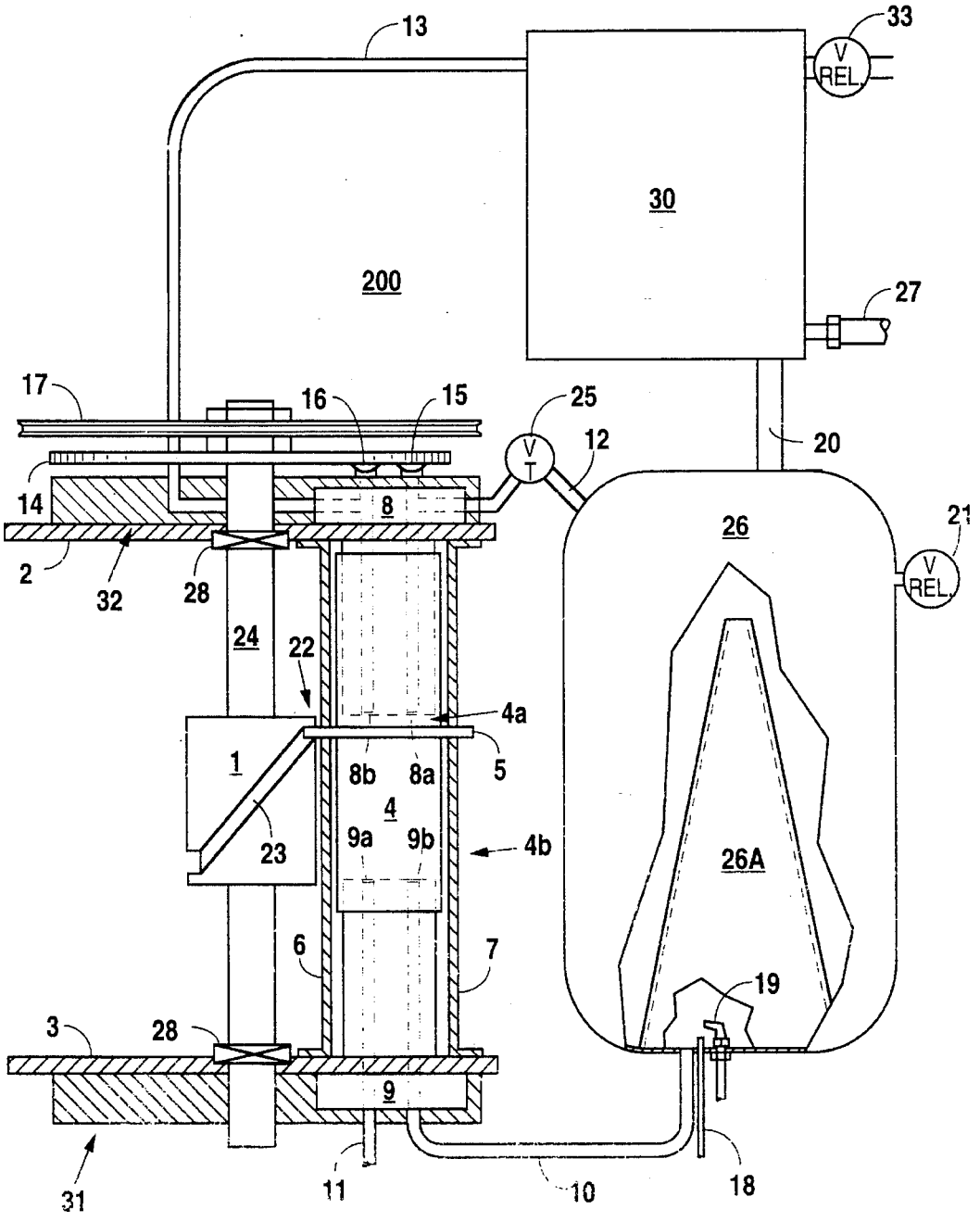
FIG. 1 is a typical side view of the hybrid steam engine showing a single reciprocating cylinder with stationary power and compressor pistons.

The hybrid steam engine of this invention is shown in FIGS. 1–4 and referenced generally therein by the numeral (200). Referring particularly to FIG. 1, it may be seen that the hybrid steam engine (200) consists of a rotor shaft (24) which is supported at the lower end by a compressor end plate (3) while contacting a set of rotor shaft bearings (28) which allow the rotor shaft (24) to turn while the compressor end plate (3) remains stationary. The rotor shaft (24) is supported at its upper end by a power end plate (2), contacting a set of rotor shaft bearings (28) which allow the rotor shaft (24) to turn while power end plate (2) remains stationary. Fixed power piston (8) is rigidly attached to power end plate (2) and remains stationary. Fixed compressor piston (9) is rigidly attached to compressor end plate (3), and remains stationary. First and second cylinder guide bars (6) and (7) are rigidly attached to power end plate (2) on one end and compressor end plate (3) on the other end so as to fix power end plate (2) and compressor end plate (3) at a predetermined distance from each other.

Reciprocating cylinder (4) is constructed as a hollow cylinder with a septum plate (5) dividing the internal volume of the hollow cylinder into two separate portions, a power cylindrical portion (**4*a*), and a compressor cylindrical portion (4*b*). Reciprocating cylinder (4) is mounted in such a manner as to allow entry of the fixed power piston into one end, creating a closed volume between fixed power piston (8) and septum plate (5). Reciprocating cylinder (4) is also mounted so as to create a closed volume between fixed compressor piston (9) and the other side of septum plate (5). As the septum plate (5) is moved closer to fixed power piston (8) so that the volume of power cylindrical portion (4*a*) is decreased, the distance between septum plate (5) and fixed compressor piston (9) increases, which serves to enlarge the volume of compressor cylindrical portion (4*b***).

The reciprocating motion of reciprocating cylinder (4) is converted to the rotary motion of rotor shaft (24) by means of a rotor cam follower pin (22) which is attached to the outside of reciprocating cylinder (4) at a point roughly midway along its longitudinal axis so as to engage a rotor cam groove (23) cut into rotor (1), which is attached to rotor shaft (24) at a point approximately midway along the longitudinal axis of rotor shaft (24). Rotor cam groove (23) is cut into rotor (1) so as to form a helical groove for approximately 180° of rotation around the longitudinal axis of rotor (1). At this point, rotor cam groove (23) traverses a reverse helix around the remainder of the circumference of rotor (1), back to its starting point.

Fixed compressor piston (9) is fitted with an intake check valve (**9*a*) which allows air from the atmosphere to enter compressor cylindrical portion (4*b*) through air intake (11). Fixed compressor piston (9) is also fitted with a compressor check valve (9*b*) which allows expulsion of compressed air from compressor cylindrical portion (4*b*) to retort (26*a*) by way of compressed air duct (10). Fixed power piston (8) is fitted with a power check valve (8*a*) which allows the intake of steam and gases produced by combustion within the retort (26*a*) into power cylindrical portion (4*a*) by way of steam duct (12). Fixed power piston (8) is also fitted with an exhaust check valve (8*b*) which allows expulsion of steam and gases from power cylindrical portion (4*a*) into condenser (30) by way of exhaust duct (13). Power check valve (8*a*), exhaust check valve (8*b*), intake check valve (9*a*), and compressor check valve (9*b***) all operate as one-way valves to prevent blowback of compressed gases.

Attached to the upper end of the rotor shaft (24) is a valve cam plate (14) fitted with a radial steam valve cam (15) and a radial exhaust valve cam (16) which move to operate power check valve (**8*a*) and exhaust check valve (8*b*) in a timely manner when rotor shaft (24) turns. Also attached to the upper end of the rotor shaft (24) is a starter gear (17) which can be engaged by a conventional starter mechanism so as to cause rotor shaft (24) to turn about its longitudinal axis. Sensors may be mounted at various points on the hybrid steam engine (200) so as to provide for electronic actuation of power check valve (8*a*), exhaust check valve (8*b*), intake check valve (9*a*), and compressor check valve (9*b***) by a central processing unit, instead of physical actuation by cams or air pressure.

The retort (**26*a*) is fitted with a fuel injector (18) and an ignition source (19), both of which operate to produce combustion in the interior of the retort (26*a*). The boiler (26), which surrounds the retort (26*a*) is fitted with a water injector (20) that is supplied with water from the condenser (30). The combination of water supplied by water injector (20) and combustion heat produced by the combination of compressed air entering by way of compressed air duct (10), fuel entering by way of fuel injector (18), and the energization of ignition source (19) produces steam within the boiler (26). A boiler safety valve (21) is provided to vent excess pressure generated within the boiler (26) to the atmosphere. Steam duct (12), which carries the generated steam and gases to combustion power cylindrical portion (4*a*) is fitted with a throttle valve (25) which regulates the amount of gas available to fixed power piston (8). Sensors may be mounted at various points on hybrid steam engine (200) so as to provide for electronic actuation of fuel injector (18), ignition source (19), and water injector (20**) by a central processing unit.

The condenser (30) is fitted with a water injector supply 27 which allows replacement of water that has not been recovered from the hybrid steam engine (200) exhaust. The condenser (30) is also fitted with a condenser exhaust valve (33), which is provided to safely vent excess pressure from hybrid steam engine (200) exhaust into the atmosphere.

Figure 2:
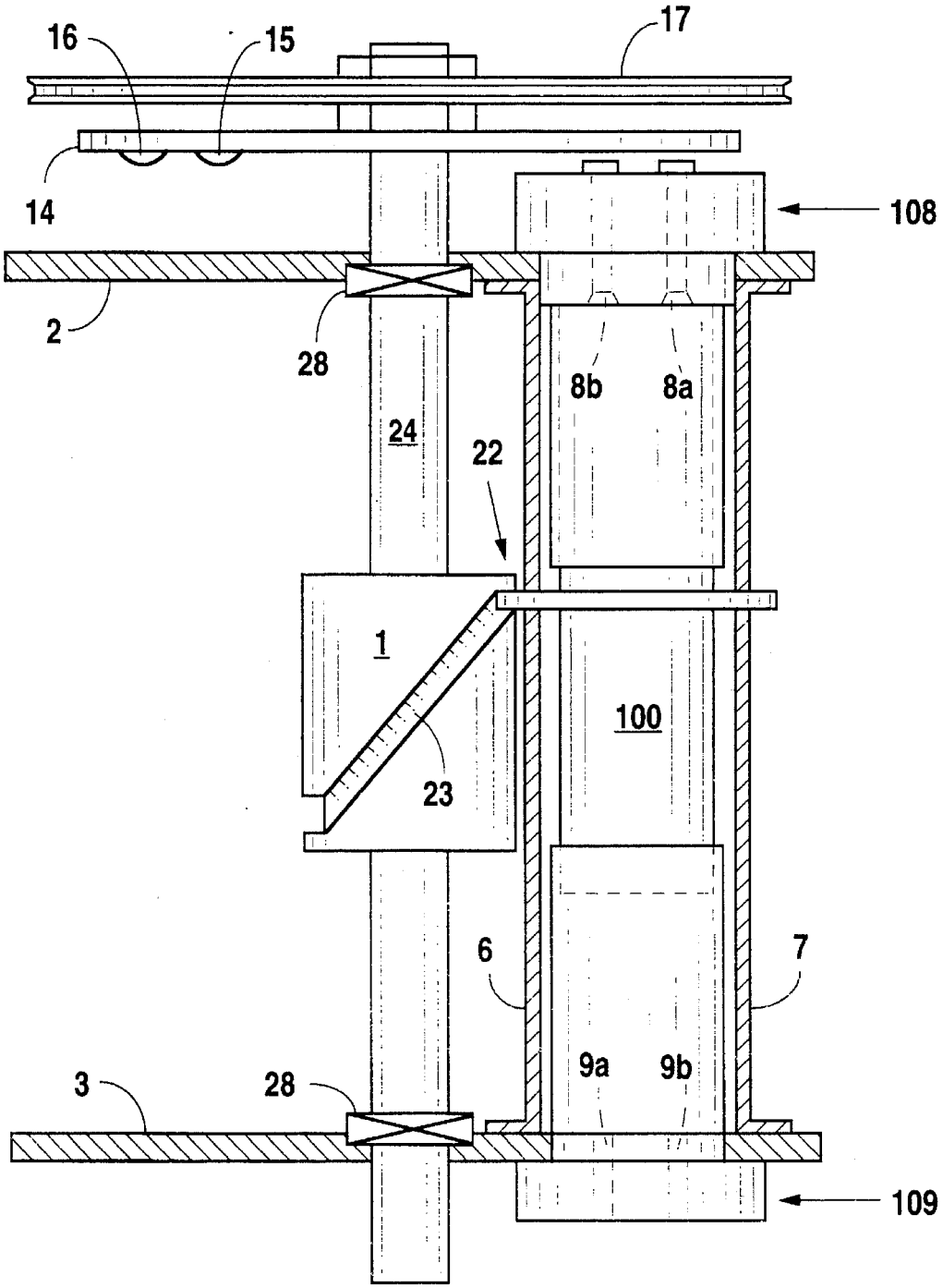
FIG. 2 is a typical side view of a portion of the hybrid steam engine showing a single, reciprocating piston with stationary power and compressor cylinders.

Referring now to FIG. 2, an alternative method of construction for the hybrid steam engine (200) can be seen. In this case, the fixed pistons and reciprocating cylinder shown in FIG. 1 are replaced by a reciprocating piston (100) which fits into a set of fixed cylinders, fixed power cylinder (108) and fixed compressor cylinder (109). In this alternative embodiment, there is no need for a septum plate. The rotor cam follower pin (22) is fixed to reciprocating piston (100) approximately mid-way from each end so as to engage the rotor cam groove (23) which encircles rotor (1). Power check valve (8*a*), exhaust check valve (8*b*), intake check valve (9*a*), and compressor check valve (9*b*) all serve the same functions as described above. In this embodiment, as in the one heretofore described, first and second cylinder guide bars (6) and (7) can be slotted for reception of the rotor cam follower pin (22) so as to prevent twisting of reciprocating piston (100) (or in the case of FIG. 1, reciprocating cylinder (4)), and maintain its alignment with fixed power cylinder (108) and fixed compressor cylinder (109).

Another method of construction for the hybrid steam engine (200) involves the use of a conventional crankshaft arrangement, where each power piston would be opposed by a compression piston of similar displacement. Cylinders could be arranged in a straight line, V-shape, or radial fashion. This method is not illustrated in the figures.

Figure 3:
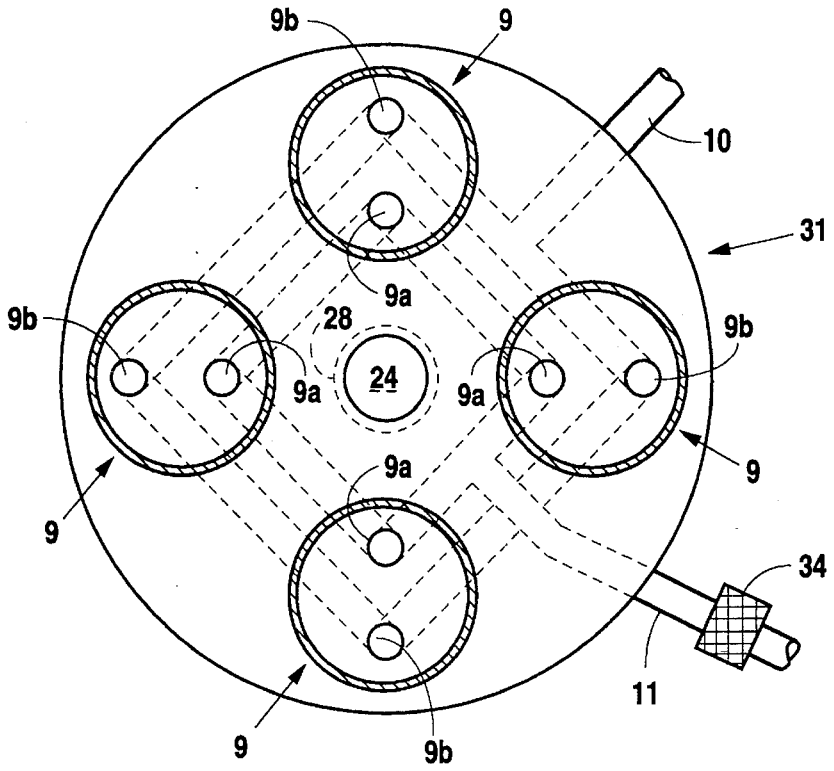
FIG. 3 is a bottom view of a typical intake manifold configured for use with four cylinders.
Figure 4:
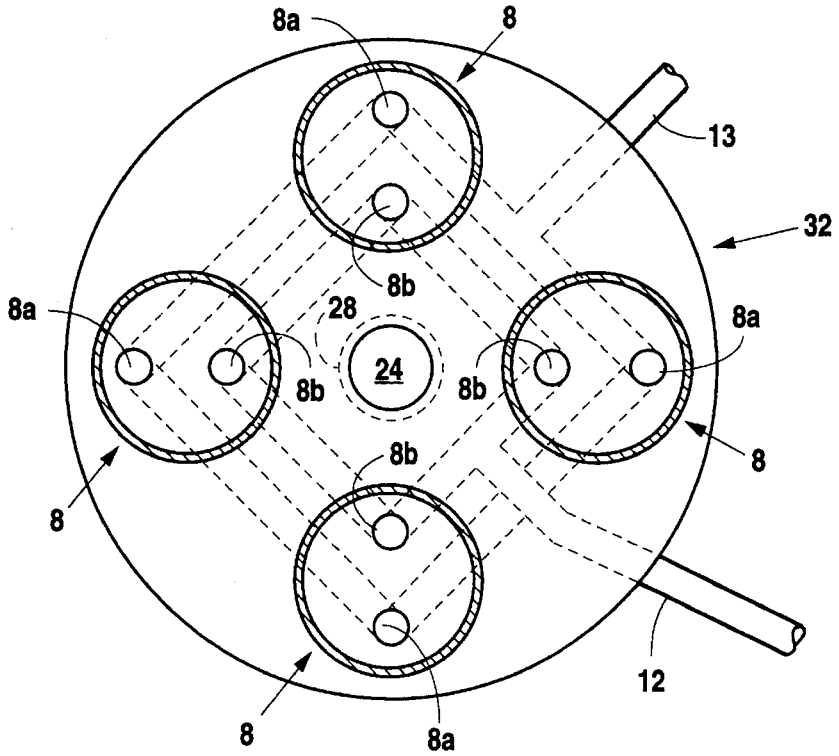
FIG. 4 is a top view of a typical exhaust manifold configured for use with four cylinders.

Referring now to FIGS. 3 and 4, it can be seen that the present invention is readily adaptable to a configuration which involves multiple cylinders; in this case a four-cylinder configuration is illustrated. The entire configuration shown in FIG. 3 is referred to generally as the intake manifold (31). In FIG. 3, four fixed compressor pistons (9) are arranged in a radial manner about the rotor shaft (24). Each fixed compressor piston is fitted with an intake check valve (9*a*) and a compressor check valve (9*b*). All of the intake check valves (9*a*) communicate together by way of air intake (11), which may be fitted with an intake filter (34) to provide clean atmospheric air to the respective compressor cylindrical portions (4*b*). All of the compressor check valves (9*b*) communicate together by way of compressed air duct (10). Compressed air from each of these fixed compressor pistons (9) is allowed to exit to the retort (26*a*).

Referring now to FIG. 4, it can be seen that four fixed power pistons (8) are arranged in a radial fashion about the rotor shaft (24), so as to correspond to the configuration shown in FIG. 3. The entire configuration shown in FIG. 4 is denoted generally as the exhaust manifold (32). Each fixed power piston (8) is fitted with a power check valve (8*a*) and an exhaust check valve (8*b*). Each of the power check valves (8*a*) communicates by way of a common steam duct (12) which allows entry of gases from the retort (26) into the power cylindrical portion (4*a*) corresponding to each power piston (8). All of the exhaust check valves (8*b*) communicate through a common exhaust duct (13) which allows expulsion of gases from each power cylindrical portion (4*a*) to condenser (30).

Referring now back to FIG. 1, the hybrid steam engine (200) is operated by turning the starter gear (17) with any conventional mechanism, such as an electric starter motor. Rotation of the starter gear (17) in turn causing the rotor shaft (24) to move about its longitudinal axis along with rotor (1). Rotor cam follower pin (22) is engaged in the rotor cam groove (23). Rotation of the helix described by rotor cam groove (23) drives the septum plate (5) of movable cylinder (4) away from fixed compressor piston (9), thereby increasing the volume of compressor cylindrical portion (4*b*), which brings in atmospheric air that passes through intake check valve (9*a*). As rotor shaft (24) continues to turn, the septum plate (5) is forced closer to fixed compressor piston (9) thereby decreasing the volume of compressor cylindrical portion (4*b*) and forcing compressed air through compressor check valve (9*b*) into the retort (26*a*). At this point, the fuel injector (18) supplies an amount of combustible fuel stoichiometrically correct for complete combustion to the interior of the retort (26*a*). At that point, the fuel is ignited by energizing the ignition source (19). Water is introduced by way of the water injector (20) to the interior of the boiler (26). This water is converted to steam using combustion heat.

When sufficient pressure has built up within the boiler (26), steam and combustion gases are released through steam duct (12) so as to enter the power cylindrical portion (4*a*) using throttle valve (25). As pressure builds within the power cylindrical portion (4*a*), septum plate (5) of reciprocating cylinder (4) is forced away from fixed power piston (8), which results in powered rotation of rotor shaft (24) by means of rotor cam follower pin (22) engaging rotor cam groove (23). At the same time, the next charge of air is being compressed within the compressor cylindrical portion (4*b*) by the fixed compressor piston (9). At the end of the power/compression stroke, the rotor (1) brings the reciprocating cylinder (4) back to its original position where atmospheric air can be taken in through air intake (11) and intake check valve (9*a*). As fresh air is taken into the compressor cylindrical portion (4*b*), exhaust steam and gases are forced out of the power cylindrical portion (4*a*) through exhaust duct (13) into the condenser (30). This condenser (30) serves to convert the steam back into water for storage and replenishment of the water required by the boiler (26). It is expected that most of the water present in the exhaust from power cylindrical portion (4*a*) will be recovered for use in the boiler (26), so that minimal water will be required for addition to the hybrid steam engine (200) by way of water injector supply (27). Using distilled water will prevent the production of large amounts of boiler scale on the walls of the boiler (26).

It can be noted by reference to FIG. 1 that the angle of the helix described by rotor cam groove (23) will determine the length of stroke, and the ratio of power and pressure to rotary motion by the rotary shaft (24). It should be noted that the motion of rotor cam follower pin (22) may also be constrained by cutting longitudinal slots through first and second cylinder guide bars (6) and (7), where the length of the slot may determine the maximum allowable excursion of movable cylinder (4). Such slots could be lined with materials known for long wearing properties, such as a brass-bronze shield or wear insert for longer wear.

Throttle valve (25) is of commonly known design. Throttle valve (25) controls the speed and power of hybrid steam engine (200), and can be operated by hand, foot, or electronic speed controller.

Referring now to FIG. 2, hybrid steam engine (200) may also be implemented by utilizing a combination of fixed cylinders and a reciprocating piston. Such an arrangement is shown where reciprocating piston (100) is placed so as to travel within the confines of fixed power cylinder (108) and fixed compressor cylinder (109). The operation of power check valve (8*a*), exhaust check valve (8*b*), intake check valve (9*a*), and compressor check valve (9*b*) is similar to that described for the hybrid steam engine (200) as represented in FIG. 1. That is, valve operation serves the same purposes in those configurations illustrated by FIGS. 1 and 2. All valves are of commonly known construction and materials, but may be coated with special high temperature, low friction coatings to enable operation of hybrid steam engine (200) without means of conventional lubrication. In a similar fashion, the pistons and cylinders of the hybrid steam engine (200) may also be constructed of conventional materials using piston rings for seating purposes, or they may be coated with special high temperature, low friction materials. In the case of operation using conventional lubrication, multiple cams may be mounted to rotor shaft (24), in a manner similar to that shown for valve cam plate (14), providing the impetus for a conventional cam-operated oil pump to supply suitable lubrication. Other cams may be mounted to rotor shaft (24) to provide for mechanical actuation of the fuel injector (18), water injector (20), or any other components where such actuation is useful.

Rotor shaft bearing sets (28) may be of commonly known manufacture, such as tapered roller bearings. Similarly, the rotor cam follower pin (22) may be equipped with a conventional needle bearing to reduce friction as it follows rotor cam groove (23).

A grooved elliptical plate may be substituted for the rotor (1) and rotor cam groove (23) to reduce the total weight of hybrid steam engine (200). To further save weight, fixed power piston (8) and fixed compressor piston (9) may be hollowed out.

Referring now to FIGS. 3 and 4, intake manifold (31) may be constructed of either tubing and suitable fittings, or (illustrated in FIG. 3) as a cast assembly bolted to the compressor end plate (3). Similarly, exhaust manifold (32), may be constructed from tubing and fittings, or (illustrated in FIG. 4) as a cast assembly bolted to power end plate (2). To reduce heat loss, and for safety purposes, the entire hybrid steam engine (200), especially intake manifold (31) and exhaust manifold (32), can be surrounded with an insulating jacket. Insulation can also be used to cover all exposed connecting pipes. The fixed pistons of the present invention (8 and 9) may be cast integrally with their respective manifolds (31 and 32), and then machined for precise fit. The pistons (8 and 9) may also be fitted with sealing rings as needed. It is readily apparent from FIGS. 3 and 4 that hybrid steam engine (200) may be constructed with any number of cylinders, although only single cylinder and four cylinder configurations have been illustrated.

After hybrid steam engine (200) is operating, provisions may be made for more precise control of pressure and temperature within the boiler (26) and retort (**26*a*). A conventional thermostat may be used to admit water into the boiler (26) from the condenser (30) when a suitable temperature is achieved. If the pressure within the boiler (26) goes beyond a preset desired level, retort safety valve (21) may be opened to decrease the pressure within the boiler (26). Also, pressure may be diminished within the boiler (26) by diminishing the amount of fuel admitted by fuel injector (18**), causing combustion to occur under lean burn conditions.

Hybrid steam engine (200) is intended to improve upon the operation of both conventional internal combustion engines and conventional steam engines. More efficient operation is expected to derive from direct application of combustion heat to water for the production of steam, along with recovery of steam for conversion back to water for reintroduction to the boiler (26). Combustion should also be more efficient, since fuel burn time is not hampered by increased engine speeds. The design of hybrid steam engine (200) is readily adaptable to operation with any number of cylinders and is expected to be more reliable and less expensive to manufacture than conventional engines because relatively few parts of are required.

During operation, hybrid steam engine (200) is expected to provide high torque at low speeds, unlike conventional internal combustion engines. Hybrid steam engine (200) is also expected to operate at relatively low temperatures and pressures, as compared to conventional internal combustion engines. Additionally, it is expected that the production of oxygen nitrides by hybrid steam engine (200) will be significantly reduced.

While specific operational configurations and materials have been mentioned, it should be realized that there is the possibility of utilizing many other different materials and configurations. As an example, instead of plain water, mixtures of water and alcohol or other fluids may be injected into the boiler (26) by the water injector (20). Furthermore, instead of constructing hybrid steam engine (200) with conventional materials, special high temperature low friction materials may be used so as to realize operation without the requirement of conventional lubrication. Finally, hybrid steam engine (200) should perform in an acceptable fashion if combustible fuels such as kerosene, diesel fuel, heating oil, or even crude oil with the impurities taken out are used as the fluid introduced to the retort (**26*a*) by way of the fuel injector (18**). It is not recommended, however, that volatile fuels such as gasoline be used.

The pressure and operating temperatures in hybrid steam engine (200) can be set at many different levels. It is expected that hybrid steam engine (200) may run at pressures as low as 50 psi and at relatively low temperatures. Such a power plant could be installed in the home and used for heating purposes, or for generating power, at relatively low cost. Finally, since combustion within the hybrid steam engine (200) is not an explosive process, and exhaust is passed directly to a condenser, it is expected that little noise will be produced when compared with conventional internal combustion engines.

Although the invention has been described with reference to specific embodiments, this description is not meant to be construed in a limited sense. Various modifications of the disclosed embodiments, as well as alternative embodiments of the invention will become apparent to persons skilled in the art upon reference to the description of the invention. It is, therefore, contemplated that the appended claims will cover such modifications that fall within the scope of the invention.

I claim:

1. A hybrid steam engine having a plurality of reciprocating cylinders, said hybrid steam engine comprising:

a rotor shaft secured near a first rotor shaft end by a power end plate, said power end plate supporting said first rotor shaft end with a first set of rotor shaft bearings, said rotor shaft secured near a second and opposing rotor shaft end by a compressor end plate, said compressor end plate supporting said second and opposing rotor shaft end with a second set of rotor shaft bearings;

a first guide bar and a second guide bar, said first and said second guide bars rigidly connecting said power end plate and said compressor end plate;

a plurality of power pistons rigidly affixed to said power end plate and a plurality of compressor pistons rigidly affixed to said compressor end plate, said power pistons and said compressor pistons each mounted so as to fit within and close off opposing ends of said reciprocating cylinders, each of said reciprocating cylinders having a septum plate dividing the interior of said reciprocating cylinders into a power cylindrical portion and a compressor cylindrical portion, the volume of said power cylindrical portion decreasing as said reciprocating cylinders move to increase the volume of said compressor cylindrical portion, and said volume of said power cylindrical portion increasing as said reciprocating cylinders move to decrease said volume of said compressor cylindrical portion, said reciprocating cylinders each movably connected to said rotor shaft by a rotor cam follower pin which converts reciprocating motion of said reciprocating cylinders to rotary motion of said rotor shaft;

a one-way intake check valve which allows introduction of atmospheric air into said compressor cylindrical portion;

a one-way compressor check valve which allows expulsion of said atmospheric air into a retort, said retort having an ignition source, a fuel injector, a water injector, and a steam duct;

a one-way power check valve which allows the introduction of retort gases and steam into said power cylindrical portion by way of said steam duct, the amount of said retort gases and said steam being regulated by a throttle means;

a one-way exhaust check valve which allows expulsion of said retort gases and said steam into a condenser by an exhaust duct, said condenser having a water injector supply, said condenser providing water to said boiler using said water injector;

a valve cam plate attached to said rotor shaft, said cam plate operating to open and close said power check valve and said exhaust check valve; and a starter gear attached to said rotor shaft.

2. A hybrid steam engine having a plurality of reciprocating pistons, said hybrid steam engine comprising:

a rotor shaft secured near a first rotor shaft end by a power end plate, said power end plate supporting said first rotor shaft end with a first set of rotor shaft bearings, said rotor shaft secured near a second and opposing rotor shaft end by a compressor end plate, said compressor end plate supporting said second and opposing rotor shaft end with a second set of rotor shaft bearings;

a first guide bar and a second guide bar, said first and said second guide bars rigidly connecting said power end plate and said compressor end plate;

a plurality of power cylinders rigidly affixed to said power end plate and a plurality of compressor cylinders rigidly affixed to said compressor end plate, said power cylinders and said compressor cylinders each mounted so that opposing ends of said reciprocating pistons fit within and close off the open ends of each of said power cylinders and said compressor cylinders simultaneously, forming a power cylindrical portion and a compressor cylindrical portion, the volume of said power cylindrical portion decreasing as said reciprocating pistons move to increase the volume of said compressor cylindrical portion, and said volume of said power cylindrical portion increasing as said reciprocating pistons move to decrease said volume of said compressor cylindrical portion, said reciprocating pistons each movably connected to said rotor shaft by a rotor cam follower pin which converts reciprocating motion of said reciprocating pistons to rotary motion of said rotor shaft;

a one-way intake check valve which allows introduction of atmospheric air into said compressor cylindrical portion;

a one-way compressor check valve which allows expulsion of said atmospheric air into a boiler, said boiler having a water injector, a steam duct, and a retort, said retort having an ignition source and a fuel injector;

a one-way power check valve which allows the introduction of retort gases and steam into said power cylindrical portion by way of said steam duct, the amount of said retort gases and said steam being regulated by a throttle means;

a one-way exhaust check valve which allows expulsion of said retort gases and said steam into a condenser by an exhaust duct, said condenser having a water injector supply, said condenser providing water to said boiler using said water injector;

a valve cam plate attached to said rotor shaft, said cam plate operating to open and close said power check valve and said exhaust check valve; and a starter gear attached to said rotor shaft.

3. The hybrid steam engine of claim 1, wherein:

said condenser provides said water, mixed with a fluid other than said water, to said boiler.

4. The hybrid steam engine of claim 1, wherein:

said condenser provides a fluid other than said water to said boiler.

5. The hybrid steam engine of claim 1, wherein:

said power pistons and said compressor pistons are coated with a high-temperature, low-friction material.

6. The hybrid steam engine of claim 1, wherein:

the interior of said reciprocating cylinders are coated with a high-temperature, low-friction material.

7. The hybrid steam engine of claim 1, wherein:

said intake check valve, said compressor check valve, said power check valve, and said exhaust check valve are coated with a high-temperature, low-friction material so as to obviate the need for conventional lubrication.

8. The hybrid steam engine of claim 1, wherein:

a first set of sensors is used to monitor conditions within said retort and provide feedback for introduction and regulation of said atmospheric air and combustible fuel into said retort, a second set of sensors is used to monitor conditions within said boiler and provide feedback for introduction and regulation of said water into said boiler, said first and said second sets of sensors also used to provide feedback for timely energization of said ignition source.

9. The hybrid steam engine of claim 1, wherein:

the operation of said intake check valve, said compressor check valve, said power check valve, and said exhaust check valve is controlled by a central processing unit.

10. The hybrid steam engine of claim 1, wherein:

timely energization of said ignition source is controlled by a central processing unit.

11. The hybrid steam engine of claim 1, wherein:

said condenser and said retort have safety valves which operate to safely vent excess pressure into the atmosphere.

12. The hybrid steam engine of claim 2, wherein:

said condenser provides said water, mixed with a fluid other than said water, to said boiler.

13. The hybrid steam engine of claim 2, wherein:

said condenser provides a fluid other than said water to said boiler.

14. The hybrid steam engine of claim 2, wherein:

said power cylinders and said compressor cylinders are coated with a high-temperature, low-friction material.

15. The hybrid steam engine of claim 2, wherein:

the exterior of said reciprocating pistons are coated with a high-temperature, low-friction material.

16. The hybrid steam engine of claim 2, wherein:

said intake check valve, said compressor check valve, said power check valve, and said exhaust check valve are coated with a high-temperature, low-friction material so as to obviate the need for conventional lubrication.

17. The hybrid steam engine of claim 2, wherein:

a first set of sensors is used to monitor conditions within said retort and provide feedback for introduction and regulation of said atmospheric air and combustible fuel into said retort, a second set of sensors is used to monitor conditions within said boiler and provide feedback for introduction and regulation of said water into said boiler, said first and said second sets of sensors also used to provide feedback for timely energization of said ignition source.

18. The hybrid steam engine of claim 2, wherein:

the operation of said intake check valve, said compressor check valve, said power check valve, and said exhaust check valve is controlled by a central processing unit.

19. The hybrid steam engine of claim 2, wherein:

timely energization of said ignition source is controlled by a central processing unit.

20. The hybrid steam engine of claim 2, wherein:

said condenser and said retort have safety valves which operate to safely vent excess pressure into the atmosphere.

* * * * *